US011198071B2

(12) United States Patent
Svendsen et al.

(10) Patent No.: US 11,198,071 B2
(45) Date of Patent: Dec. 14, 2021

(54) COLLAPSIBLE AND PORTABLE WATER SLIDE FOR POOLS

(71) Applicant: S.R. Smith, LLC, Canby, OR (US)

(72) Inventors: William J. Svendsen, Canby, OR (US); Margaret McGrath, Canby, OR (US)

(73) Assignee: S.R. SMITH, LLC, Canby, OR (US)

( * ) Notice: Subject to any disclaimer, the term of this patent is extended or adjusted under 35 U.S.C. 154(b) by 0 days.

(21) Appl. No.: 16/886,505

(22) Filed: May 28, 2020

(65) Prior Publication Data

US 2020/0398172 A1 Dec. 24, 2020

Related U.S. Application Data

(60) Provisional application No. 62/863,194, filed on Jun. 18, 2019.

(51) Int. Cl.

| | |
|---|---|
| ***A63G 21/18*** | (2006.01) |
| ***E04H 4/14*** | (2006.01) |
| *A63G 21/00* | (2006.01) |

(52) U.S. Cl.

CPC ..... *A63G 21/18* (2013.01); *E04H 4/144* (2013.01)

(58) Field of Classification Search

CPC ..... A63G 3/00; A63G 21/00; A63G 21/18; A63G 31/007

USPC ..... 472/116, 117, 128; 104/69, 70

See application file for complete search history.

(56) References Cited

U.S. PATENT DOCUMENTS

| | | | |
|---|---|---|---|
| D218,625 | S | 9/1970 | Ahrens |
| 3,565,226 | A | 2/1971 | Winchester |
| D221,963 | S | 9/1971 | Henning |
| D227,382 | S | 6/1973 | Wormser et al. |
| 3,755,878 | A | 9/1973 | Henning |
| 3,814,418 | A | 6/1974 | Henning |
| D250,784 | S | 1/1979 | Dieter et al. |
| D262,230 | S | 12/1981 | Ament et al. |
| D268,859 | S | 5/1983 | Ament et al. |
| 4,805,897 | A | 2/1989 | Dubeta |
| 4,805,898 | A | 2/1989 | Jacober et al. |
| 4,893,807 | A | 1/1990 | Ahrens |
| D335,517 | S | 5/1993 | Vatterot |
| D344,317 | S | 2/1994 | Petersheim |
| 5,378,197 | A | 1/1995 | Briggs |
| D361,614 | S | 8/1995 | Aker et al. |

(Continued)

FOREIGN PATENT DOCUMENTS

| | | |
|---|---|---|
| CN | 202387220 U | 8/2012 |
| EP | 3381527 A1 | 10/2018 |

OTHER PUBLICATIONS

Brochure: Inter-Fab "G-Force2Slide" (2008), downloaded Jan. 2014 from http://www.interfab.com/getattachment/7c633152-bd06-4927-b344-88196bbd56d1/G-Force.aspx (one page).

(Continued)

*Primary Examiner* — Kien T Nguyen

(74) *Attorney, Agent, or Firm* — Stoel Rives LLP

(57) ABSTRACT

A water slide for a recreational pool or other body of water, the water slide including a ladder section and a chute rotatably coupled to one another to simplify disassembly and transport of the water slide when not in use. The water slide may further include a brace supporting the ladder section and chute, and a water tank designed to further stabilize the water slide during use.

20 Claims, 8 Drawing Sheets

(56) References Cited

U.S. PATENT DOCUMENTS

| | | | | |
|---|---|---|---|---|
| 5,478,281 | A | 12/1995 | Forton | |
| D372,065 | S | 7/1996 | Gilles | |
| 5,741,189 | A | 4/1998 | Briggs | |
| D418,895 | S | 1/2000 | Ruggiero | |
| D429,788 | S | 8/2000 | Sutton et al. | |
| 6,319,139 | B1 | 11/2001 | Tracy | |
| 6,375,578 | B1 | 4/2002 | Briggs | |
| 6,569,023 | B1 | 5/2003 | Briggs | |
| 6,575,840 | B2 | 6/2003 | Hagerty | |
| 6,786,830 | B2 | 9/2004 | Briggs et al. | |
| D577,408 | S | 9/2008 | Ketcherside et al. | |
| 7,431,656 | B2 * | 10/2008 | Titus | A63D 15/08 473/44 |
| D589,110 | S | 3/2009 | Ketcherside et al. | |
| D594,079 | S | 6/2009 | Ketcherside et al. | |
| 8,105,173 | B2 * | 1/2012 | Connors | A63G 21/00 472/116 |
| D703,782 | S | 4/2014 | Svendsen | |
| D731,018 | S | 6/2015 | Svendsen | |
| 9,192,866 | B2 | 11/2015 | Svendsen | |
| D760,856 | S | 7/2016 | Svendsen | |
| 2006/0189443 | A1 | 8/2006 | Finlinson et al. | |
| 2007/0101488 | A1 | 5/2007 | Ferraro, Sr. et al. | |
| 2012/0122596 | A1 * | 5/2012 | Northam | A63G 21/18 472/90 |
| 2017/0266571 | A1 | 9/2017 | Goto et al. | |

OTHER PUBLICATIONS

Brochure: SR Smith, LLC "Pool Slides" (2010), downloaded Jan. 2013 from http://www.srsmith.com (three pages).

Brochure: SR Smith, LLC "TurboTwister" model pool slide (2012), downloaded Jan. 2013 from http://www.srsmith.com/media/47937/turbotwister0312.pdf (one page).

Brochure: SR Smith, LLC "Typhoon" model pool slide (2012) downloaded Jan. 2013 from http://www.srsmith.com/media/47943/typhoon0312.pdf (one page).

Brochure: SR Smith, LLC "Vortex" model pool slide (2012), downloaded Jan. 2013 from www.srsmith.com/products/pool-slides/vortex.aspx (one page).

Online Brochure: King's Fibreglass "Swimming Pool Slides" (2012), http://www.kingsfibreglass.com.au/kings fibreglass pool slides.html Visited Dec. 12, 2013 (two pages).

Pool & Spa News, Dec. 2012 Issue, "2013 New Products Supplement" (eight pages) http://www.poolspanews.com/products/new-products-2013_2.aspx Visited May 26, 2015.

European Patent Office, Extended European Search Report for Application 20180946.4, dated Nov. 3, 2020, 7 pages.

* cited by examiner

COLLAPSIBLE AND PORTABLE WATER SLIDE FOR POOLS

RELATED APPLICATION DATA

This application is a nonprovisional of and claims the benefit under 35 U.S.C. § 119(e) of U.S. Provisional Patent Application No. 62/863,194 filed Jun. 18, 2019, the disclosure of which is incorporated by reference herein in its entirety.

BACKGROUND

The present disclosure relates generally to recreational water slides for pools, and, particularly, to such water slides designed for easy assembly, expedient disassembly, and portability for storage when not in use.

Pool slides for recreational use are generally well-known in the industry. Typically, such slides include a ladder on one end that provides access to a platform seat at the top of the slide. Upon reaching the platform seat, the user then sits and slides down the chute and exits into a pool or other body of water. To decrease friction between the chute surface and the user, many pool slides are equipped with a water delivery system designed to provide a stream of running water onto the runway surface to provide lubrication for the user.

Conventional pool slides for in-ground backyard pools are generally arranged adjacent the pool and fixedly mounted onto a pool deck or other surface. While fixedly mounting a pool provides good stability, these designs have several drawbacks. For example, mounted pool slides cannot be easily disassembled and removed from the pool deck when not in use, or they cannot be quickly repositioned to different parts of the pool as desired, or they cannot be collapsed and stored for winter when not needed for an extended period of time. Accordingly, the present inventor has identified a need for a water pool slide designed for portability, easy disassembly, and storage as needed, while providing appropriate stability to ensure that the pool slide is safe to use when deployed.

Additional aspects and advantages will be apparent from the following detailed description of example embodiments, which proceeds with reference to the accompanying drawings. It should be understood that the drawings depict only certain example embodiments of the disclosed subject matter and are not necessarily to be considered as limiting in nature. With this understanding, the embodiments will be described and explained with additional specificity and detail through the use of the accompanying drawings.

DETAILED DESCRIPTION OF EXAMPLE EMBODIMENTS

Figure 1:
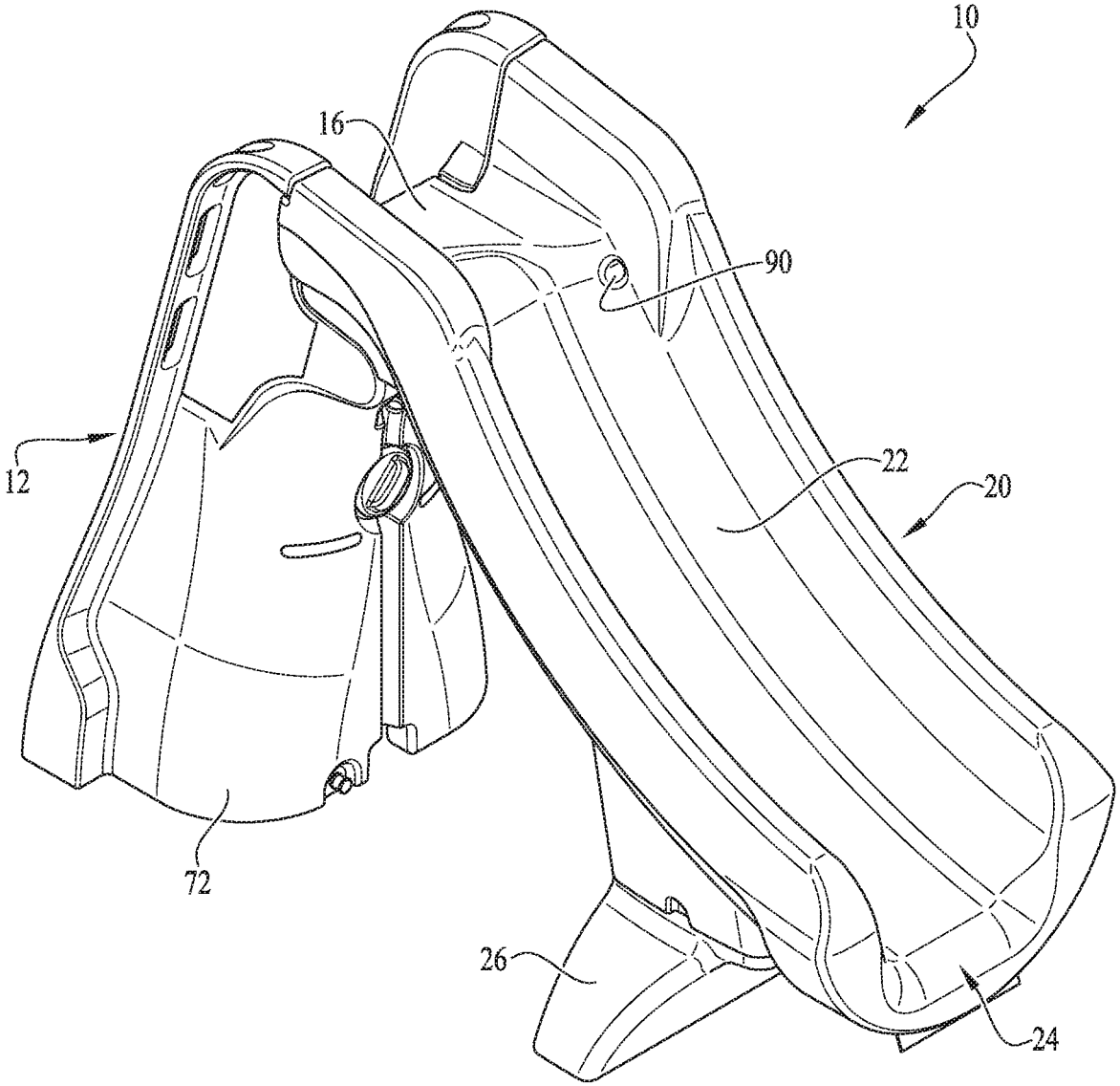
FIG. 1 is a perspective view of a water slide in accordance with one example embodiment.
Figure 3:
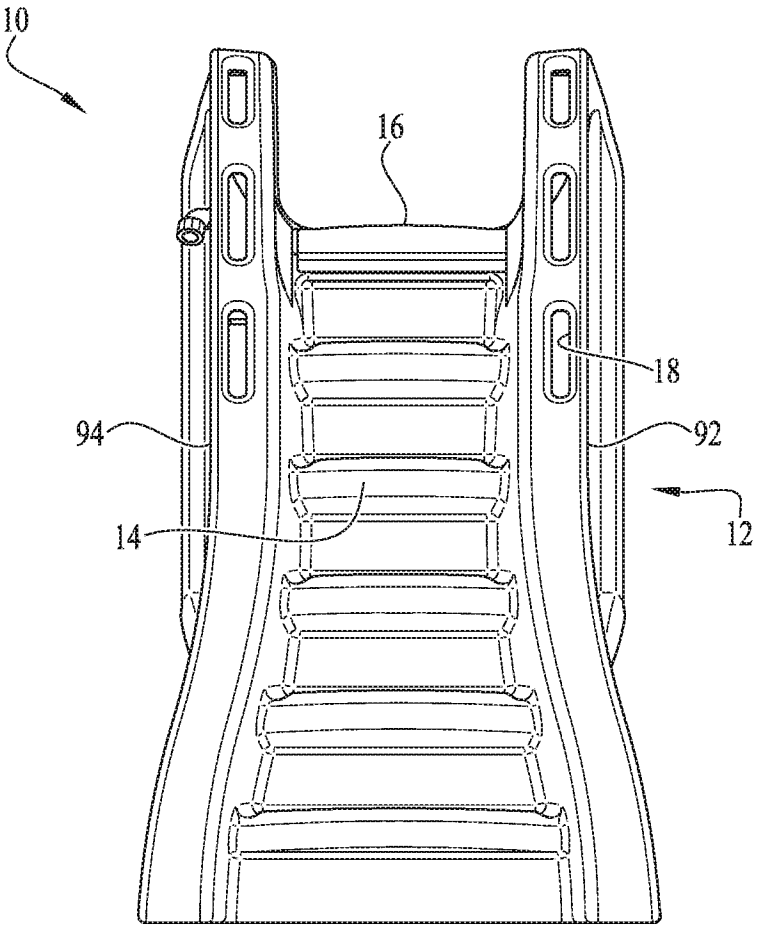
FIGS. 2-4 are front elevation, rear elevation, and side elevation views, respectively, of the water slide of FIG. 1.

With reference to the drawings, this section describes embodiments of a collapsible and portable water slide for pools and its detailed construction and operation. Throughout the specification, reference to "one embodiment," "an embodiment," or "some embodiments" is intended to mean that a described feature, structure, or characteristic may be included in at least one embodiment of the water slide being discussed. Accordingly, appearances of the phrases "in one embodiment," "in an embodiment," or "in some embodiments" in various places throughout this specification are not necessarily all referring to the same embodiment. Further, the described features, structures, and characteristics may be combined in any suitable manner in one or more embodiments. In view of the disclosure herein, those skilled in the art will recognize that the various embodiments can be practiced without one or more of the specific details, or with other methods, components, materials, or the like. In the following description, certain components of the water slide are described in detail, but it should be understood that in some instances, well-known structures, materials, or operations are not shown or not described in detail to avoid obscuring more pertinent aspects of the embodiments.

In the following description of the figures and any example embodiments, it should be understood that while the water slide is illustrated and described in the context of a swimming pool environment, this is merely one use for such a system and should not necessarily be considered as limiting. Other uses for water slides or slides in general with the characteristics and features described are envisioned and may fall within the purview of the disclosed subject matter. The following provides a brief overview of the water slide 10, followed by a more detailed discussion of its various features with reference to the figures.

FIGS. 1-12 collectively illustrate various details of a collapsible and portable water slide 10 designed for recreational pool use. As illustrated in the figures, the water slide 10 includes a ladder section 12 having a plurality of steps 14 that lead a user toward a platform 16 at the top of the slide 10. From the platform 16, the user slides along a downwardly sloped slide chute 20 and exits out over a pool or suitable body of water. As best illustrated in FIGS. 8-12, the water slide 10 is designed such that it is collapsible for easy disassembly and compact storage when not in use. To provide stability when the water slide 10 is deployed and in use, the water slide 10 includes a support brace 60 positioned along a lower portion of the water slide 10 to lock the ladder section 12 and the chute 20 and prevent the water slide 10 from collapsing during use. As further described below, the support brace 60 extends into recessed portions formed in both the ladder section 12 and the support platform 26. The water slide 10 also includes a tank 72 for holding water (or other suitable liquid) to help stabilize the water slide 10 as needed. With reference to the accompanying figures, the following describes additional features of these and other embodiments of the water slide 10.

FIGS. 1-4 collectively illustrate various features of an example water slide 10 according to one embodiment. With general reference to these figures, the water slide 10 includes a ladder section 12 having a plurality of steps 14 arranged to provide access to a top platform 16 of the water slide 10.

Each of the steps 14 extends from one side wall 92 of the ladder section 12 to an opposing side wall 94. In some embodiments, each of the steps 14 may include multiple drainage openings or perforations (not shown) formed thereon to direct water away from the steps 14 and minimize potential slipping by the users when ascending or descending the steps 14. In such embodiments, the drainage openings are preferably large enough to accommodate water drainage but small enough such that a foot, toe, finger or other extremity of a child cannot easily pass through to avoid potential injury. Preferably, the ladder section 12 includes one or more handles 18 (see FIG. 3) formed along side walls 92, 94 of the ladder section 12 to help support the user when moving up or down the stairs 14 and transitioning onto or from the top platform 16.

Figure 2:
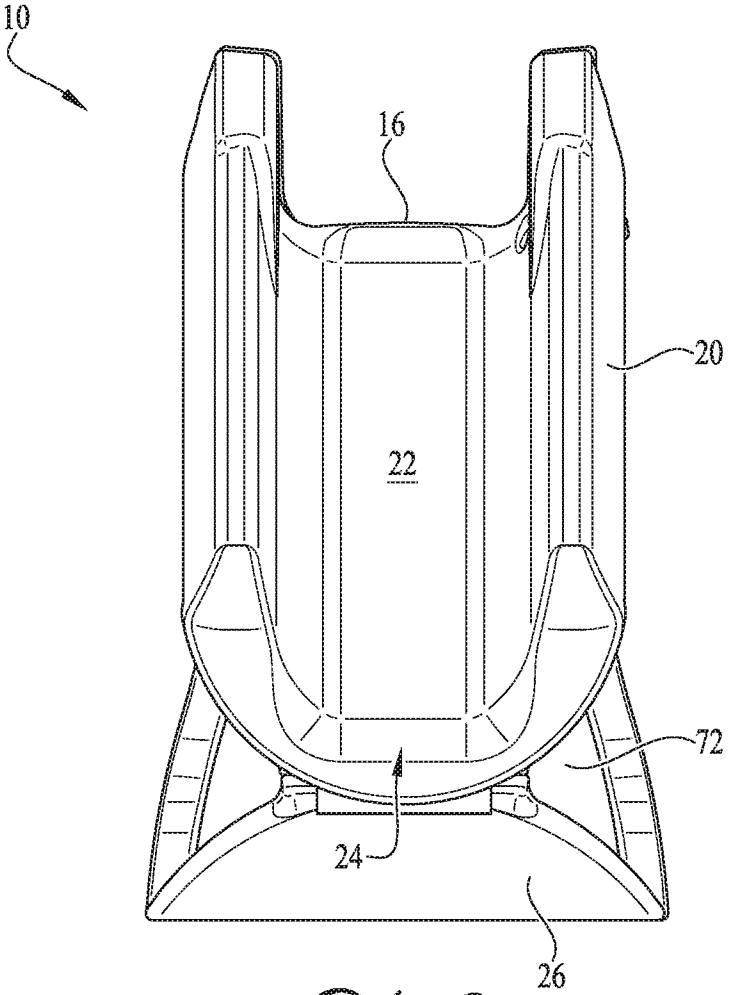

With reference to FIGS. 1-2, the slide 10 further includes a chute 20 having a runway surface 22 that extends from the top platform 16 to an exit 24 of the water slide 10. The water slide 10 is shown with a generally open chute 20 (i.e., uncovered) configuration, but the slide 10 may be designed such that the chute 20 is partially or fully enclosed in other embodiments. In addition, the chute 20 may include twists and turns in other embodiments if desired, though such design may make the overall slide 10 more cumbersome to disassemble and store. Preferably, the runway surface 22 is smooth to provide an easy and comfortable ride to the user sliding down the water slide 10 and toward the pool. In some embodiments, a water delivery system 80 (see FIGS. 11-12) may be used to lubricate the chute 20 for further minimizing sliding friction as further discussed in detail below with reference to FIGS. 11 and 12.

Figure 4:
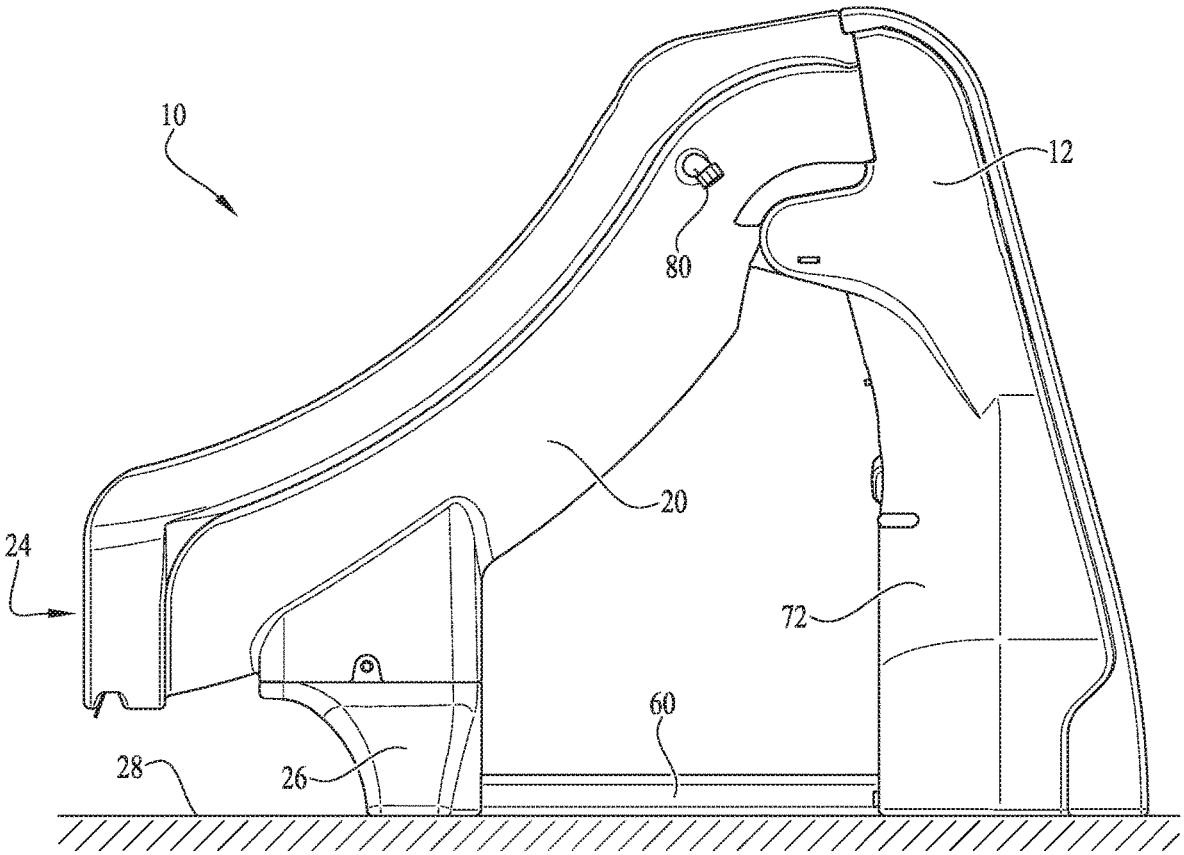
Figure 5:
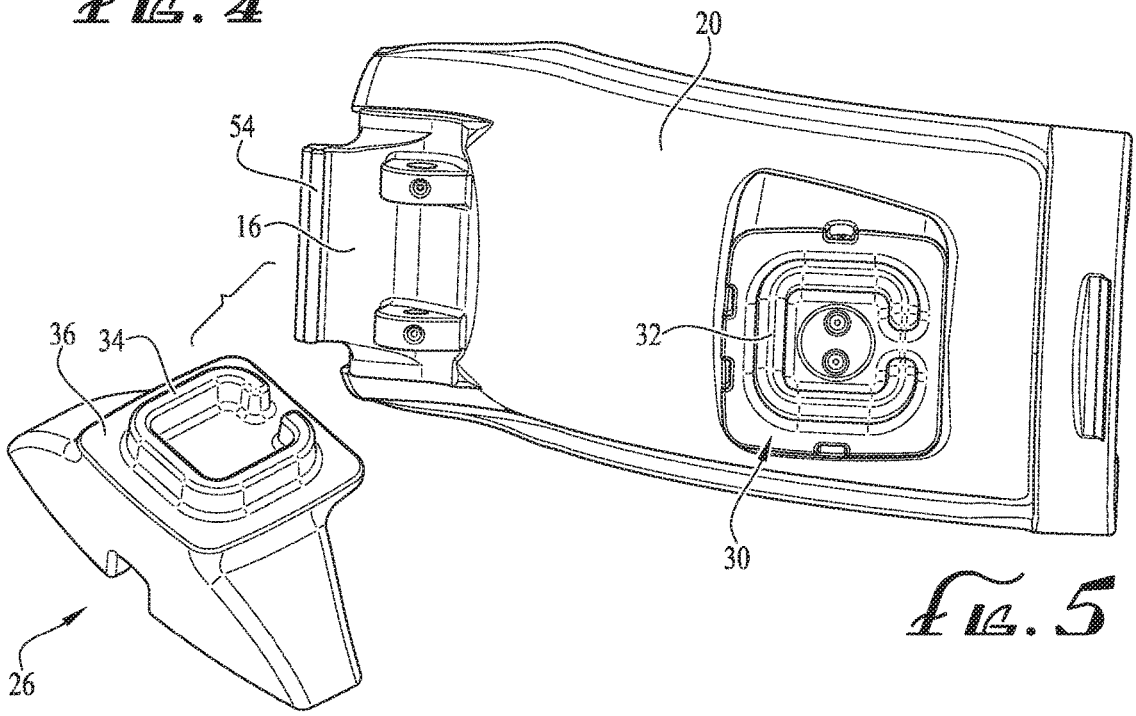
FIG. 5 is a bottom view of a slide chute of the water slide of FIG. 1 illustrating details for coupling a platform to the slide chute in accordance with one example embodiment.

Turning now to FIG. 4, the water slide 10 includes a support platform 26 positioned underneath a portion of the chute 20 and resting against the pool deck 28 or other ground surface. As illustrated, the support platform 26 includes a bottom portion that rests on the pool deck 28 and is positioned adjacent the exit 24 of the chute 20 to ensure that the chute 20 is stable as users slide down the runway surface 22. As illustrated in FIG. 4, the support platform 26 elevates the chute 20 such that the exit 24 is offset or raised above the pool deck 28 as shown in FIG. 4. In some embodiments, the support platform 26 may be formed as an integral component that is part of the chute 20. In other embodiments, the support platform 26 is formed as a separate and removable component of the water slide 10 to minimize the overall size of the water slide 10 and facilitate storage if desired. In such embodiments, the support platform 26 may be coupled to the chute 20 via any suitable coupling mechanisms or methods. FIG. 5 illustrates one such coupling mechanism as an example.

With reference to FIG. 5, in one embodiment, the underside of the chute 20 includes a recessed region 30 having a key 32 formed thereon, the key 32 designed to correspond with a mating key 34 formed on an upper surface 36 of the support platform 26. The keys 32, 34 may be formed in any suitable corresponding shape designed to engage and interlock with one another as desired. For example, in one embodiment, the key 32 of the chute 20 may be formed as a recessed C-shape, and the mating key 34 on the platform 26 may be formed as a raised C-shape designed such that the raised mating key 34 is received and sits flush within the recessed key 32 to tightly interlock the components together. Once the mating key 34 of the platform 26 is positioned within the recessed region 30 of the chute 20, fasteners (not shown) or other suitable means may be used to firmly affix the support platform 26 in position against the chute 20. As noted previously, it should be understood that other embodiments may use different recessed and raised profiles (or other different mating profile designs entirely) to couple the support platform 26 and the chute 20.

Figure 6:
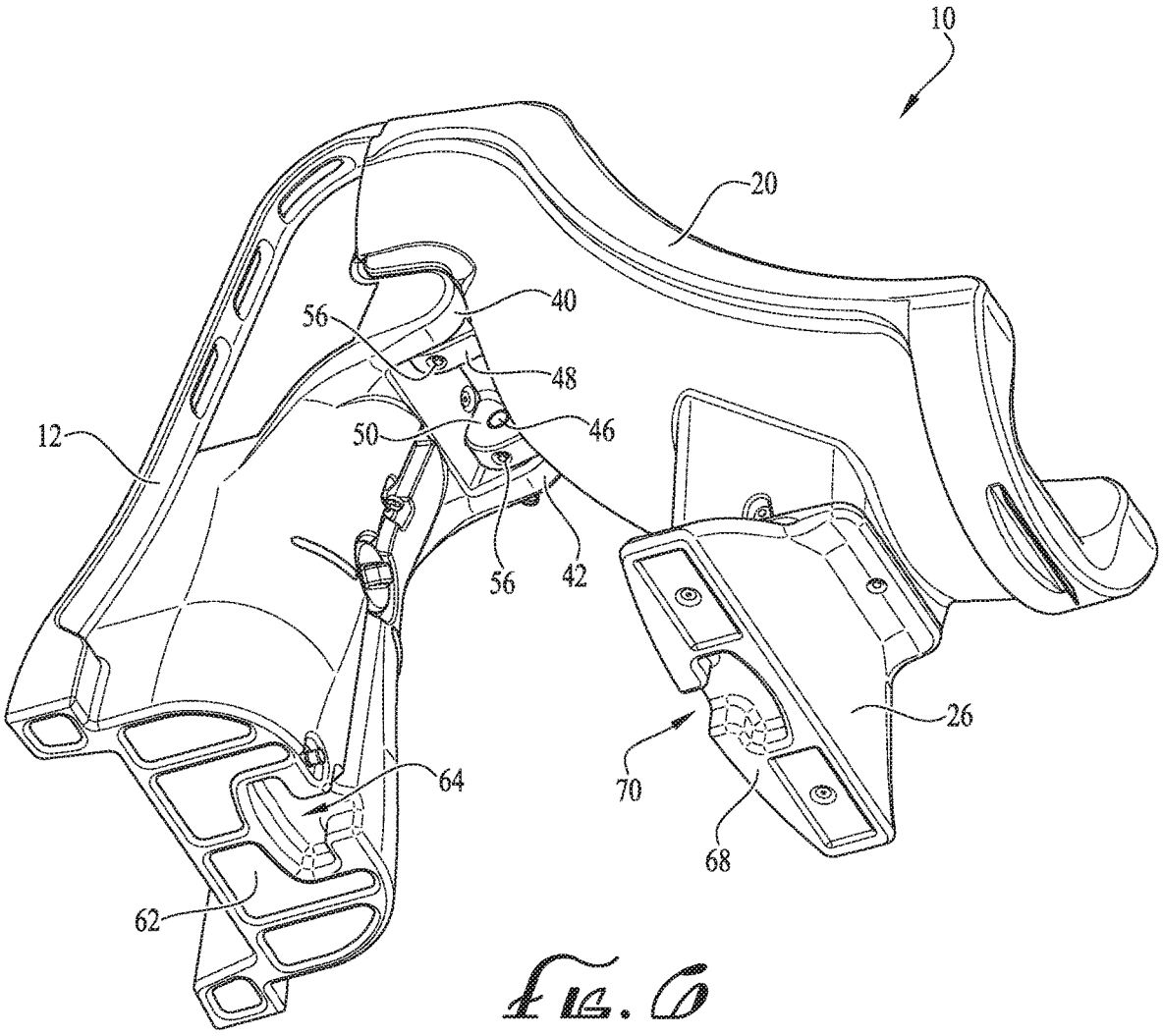
FIG. 6 is a bottom perspective view of the water slide of FIG. 1.
Figure 7:
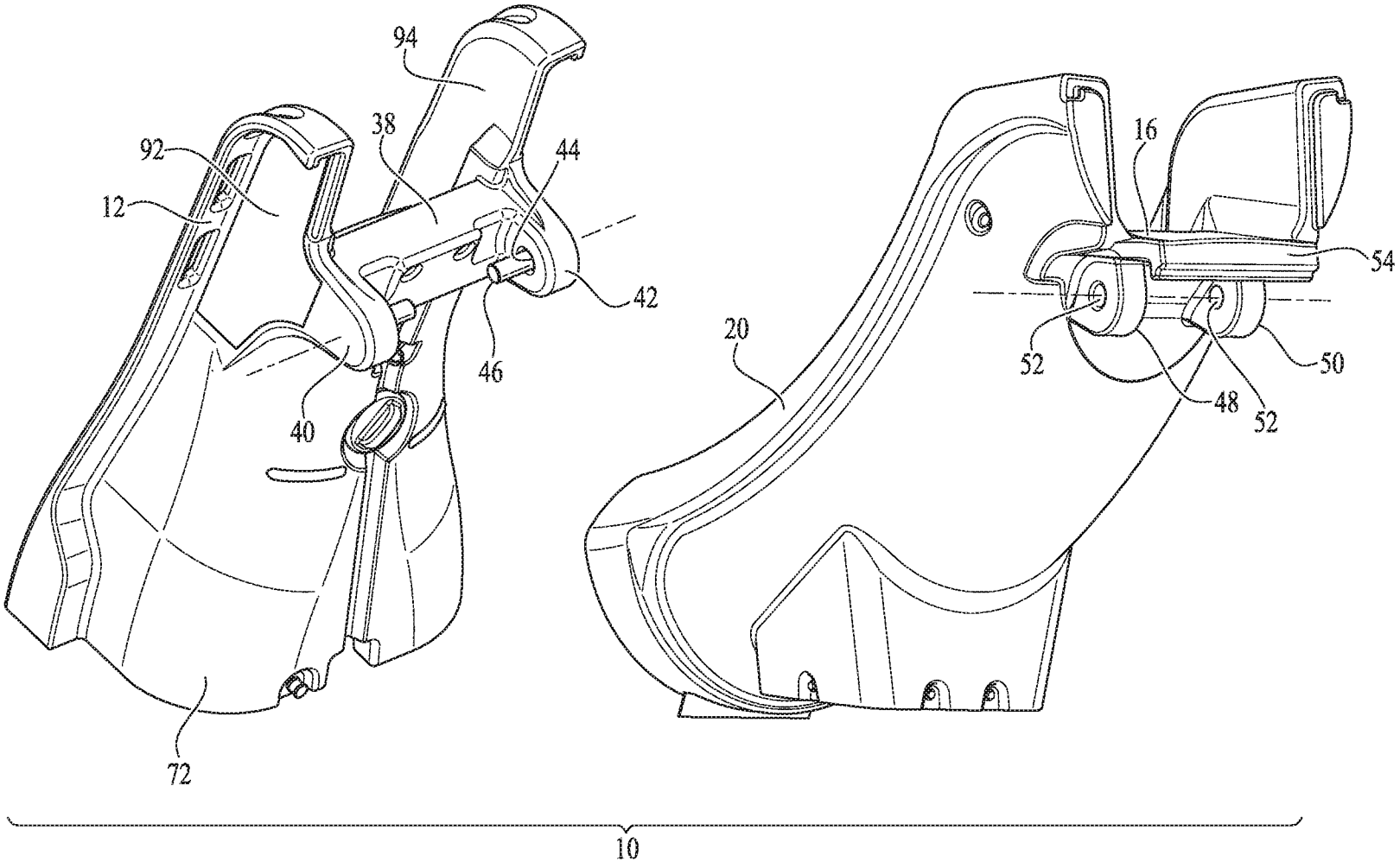
FIG. 7 is a partially exploded view of the water slide of FIG. 1 illustrating details of an example coupling system for a stair section and the slide chute.

Turning to FIGS. 6-7, the following passages describe details of an example system for rotatably coupling the ladder section 12 and the chute 20 of the water slide 10 in accordance with one embodiment. FIG. 6 illustrates a bottom view of the assembled water slide 10, and FIG. 7 illustrates a partially exploded view of the water slide 10, with the chute 20 and ladder section 12 separated from one another to illustrate additional details of the respective components.

With reference to FIG. 7, the ladder section 12 includes an upper panel 38 (which supports the top platform 16 of the chute 20 when the water slide 10 is fully assembled as further described below), the upper panel 38 extending laterally across the side walls 92, 94 of the ladder section 12. The panel 38 includes a pair of arms 40, 42 extending outwardly therefrom and away from the side walls 92, 94, where the arms 40, 42 are separated from one another on opposite ends of the upper panel 38 to form a general U-shape. In some embodiments, the panel 38, arms 40, 42, and side walls 92, 94 are preferably formed as integral components of the ladder section 12. The arms 40, 42 each include an opening 44 (see opening on arm 42) formed along a respective interior portion of the arms 40, 42, where the openings 44 of the arms 40, 42 face one another. The opening 44 is sized and dimensioned to receive a fastening pin 46 therein to secure the chute 20 as further described in detail below. The openings 44 extend transversely (i.e., along a horizontal axis) into the arms 40, 42. In some embodiments, openings 44 may extend partially into or entirely through the arms 40, 42 as desired.

Turning now to the chute 20, the chute 20 includes a pair of arms 48, 50 extending underneath the top platform 16 along an underside of the chute 20, the arms 48, 50 offset from one another. As further described in detail below, the arms 48, 50 are offset from another and positioned on the chute 20 such they align with the arms 40, 42 of the ladder section 12 to engage therewith. The arms 48, 50 each include an opening 52 extending transversely (i.e., along a horizontal axis) through the arms 48, 50, the opening 52 being of similar size and dimension as the opening 44 on the arms 40, 42. Preferably, the opening 52 extends entirely through the arms 48, 50, but it may extend only partially through in other embodiments depending on a particular arrangement of the arms 40, 42, 48, 50 as further described below.

The following provides a brief description on an example assembly process for coupling the ladder section 12 and chute 20. With collective reference to FIGS. 6 and 7, the ladder section 12 and chute 20 are brought together such that the arms 40, 42 of the ladder section 12 are adjacent the arms 48, 50 of the chute 20. When the respective arms 40, 42, 48, 50 are in proper position, the corresponding openings 44, 52 are aligned with one another. In this configuration, a lip 54 formed along a front end of the top platform 16 extends over and rests against the upper panel 38 of the ladder section 12 to support the chute 20 against the ladder section 12. With the openings 44, 52 aligned relative to one another, the fastening pin 46 is inserted therethrough to rotatably couple the ladder section 12 and chute 20 together, such that the chute 20 swings inwardly and outwardly relative to the ladder section 12 (or vice versa). In some embodiments, one or more fasteners 56 (see FIG. 6) may be used to secure the pin 46 in position within the openings 44, 52, where the fastener 56 extends through the arms 48, 50 of the chute 20 and into the pin 46.

It should be understood that the respective position of certain components may be changed in other embodiments without departing from the principles of the disclosed subject matter. For example, FIG. 6 illustrates the arms 48, 50 of the chute 20 on an interior position relative to the arms 40, 42 of the ladder section 12 when the chute 20 and ladder section 12 are coupled together. In other embodiments, the relative positions of the arms 40, 42, 48, 50 may be reversed such that the arms 40, 42 of the ladder section 12 are instead in the interior position and the arms 48, 50 are in the exterior position. In such arrangements, many of the details described above with respect to arms 40, 42 will instead apply to arms 48, 50 and vice versa as one having ordinary skill in the art will understand to accommodate similar functionality as described. As another example, the top platform 16 may instead be formed as part of the ladder section 12, and the upper panel 38 may instead be formed as part of the chute 20, where the top platform 16 and upper panel 38 operate in a similar fashion as previously described.

Figure 8:
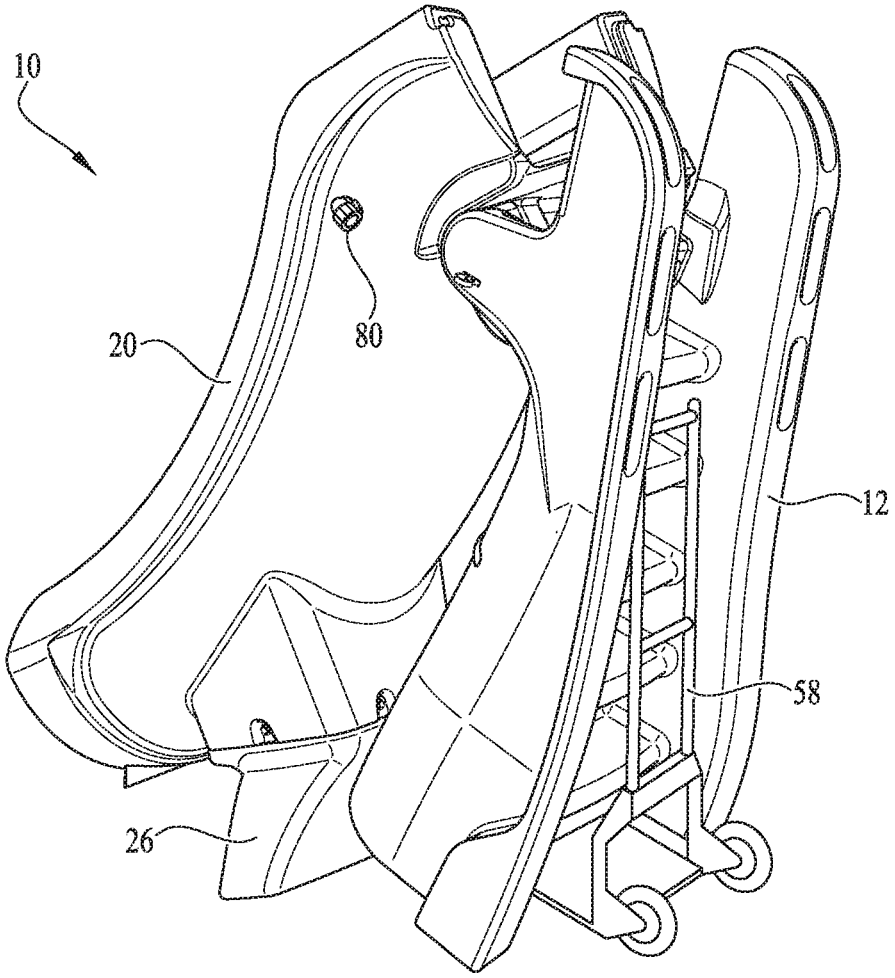
FIG. 8 is a view of the water slide of FIG. 1 shown in a collapsed configuration in accordance with one embodiment.

With collective reference to the embodiments illustrated in FIGS. 8-12, the following describes additional details relating to an example assembly and disassembly process of the water slide 10, along with a description of the water delivery system 80 of the water slide 10 mentioned previously. FIG. 8 illustrates the water slide 10 in a collapsed configuration, with the chute 20 swung inwardly along the pins 46 to a resting position against the ladder section 12. In the collapsed configuration, the water slide 10 may be easily moved to a desired location and deployed. For example, in one deployment process, a wheeled platform 58 (such as a dolly or a hand truck) may be positioned underneath the ladder section 12 such that the platform section of the wheeled platform 58 is positioned underneath the bottom-most step 14 of the ladder section 12. Thereafter, the water slide 10 may be tilted backward to transfer the weight of the water slide 10 onto the wheeled platform 58. In some embodiments, the handles 18 of the ladder section 12 may be used to guide the water slide 10 onto the wheeled platform 58 and ensure that the water slide 10 is positioned properly on the wheeled platform 58 prior to transport. In this arrangement, the water slide 10 may be moved from one position (e.g., a storage position) to another position (e.g., a desired deployment position) near a water pool or other body of water.

Once the water slide 10 has been moved to its desired deployment position, the chute 20 may be swung outwardly and away from the ladder section 12 to its full position such that the water slide 10 is in a generally free-standing position, at which point the wheeled platform 58 may be removed from underneath the ladder section 12. Thereafter, a brace 60 (see FIG. 9) may be used to lock the water slide 10 in a deployed position, where the brace 60 ensures that the chute 20 does not collapse or swing inwardly during use. As illustrated in FIG. 6, in one embodiment, an underside 62 of the ladder section 12 may include a recessed region 64 having a shape matching a first head portion 66 of the brace 60. Similarly, an underside 68 of the support platform 26 of the chute 20 includes a recessed region 70 having a shape matching a second head portion (not shown) of the brace 60. Returning to FIG. 9, to insert the brace 60, the water slide 10 may be leaned laterally in one direction to expose the underside 62 of the ladder section 12 and the underside 68 of the support platform 26 to accommodate insertion of the brace 60 into the respective recessed regions 64, 70. Once the brace 60 is in position within the respective recessed regions 64, 70, the water slide 10 is in a secured state whereat the brace 20 prevents the chute 20 from collapsing back against the ladder section 12. If the water slide 10 requires any repositioning once in its secured state, the water slide 10 may be moved as desired to a proper location on the pool deck 28. While the brace 60 may provide sufficient stability for operation of the water slide 10, in some embodiments, the water slide 10 may further include a chamber or tank 72 formed within the ladder section 12 to further stabilize the water slide 10 as further described below.

Figure 10:
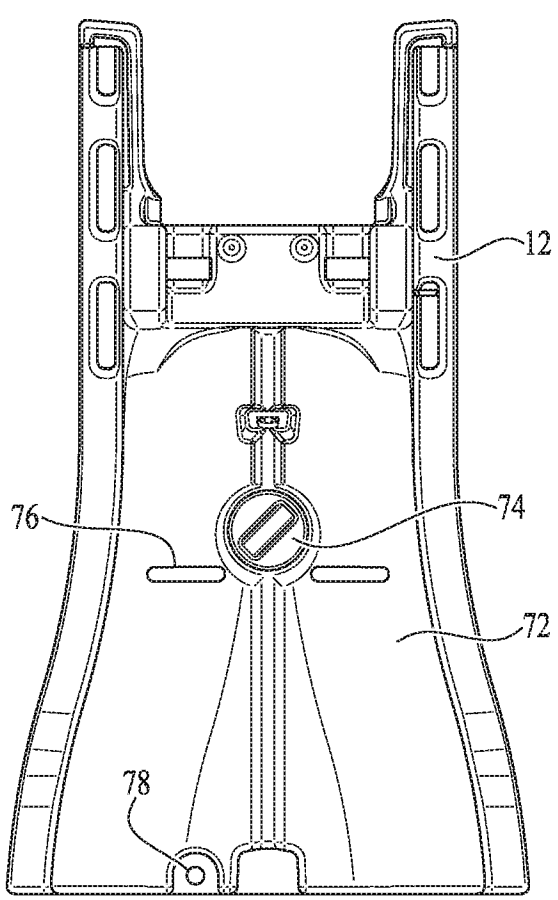
FIGS. 9-12 collectively illustrate various steps associated with a method for deploying the water slide of FIG. 1 in accordance with one embodiment.
Figure 9:
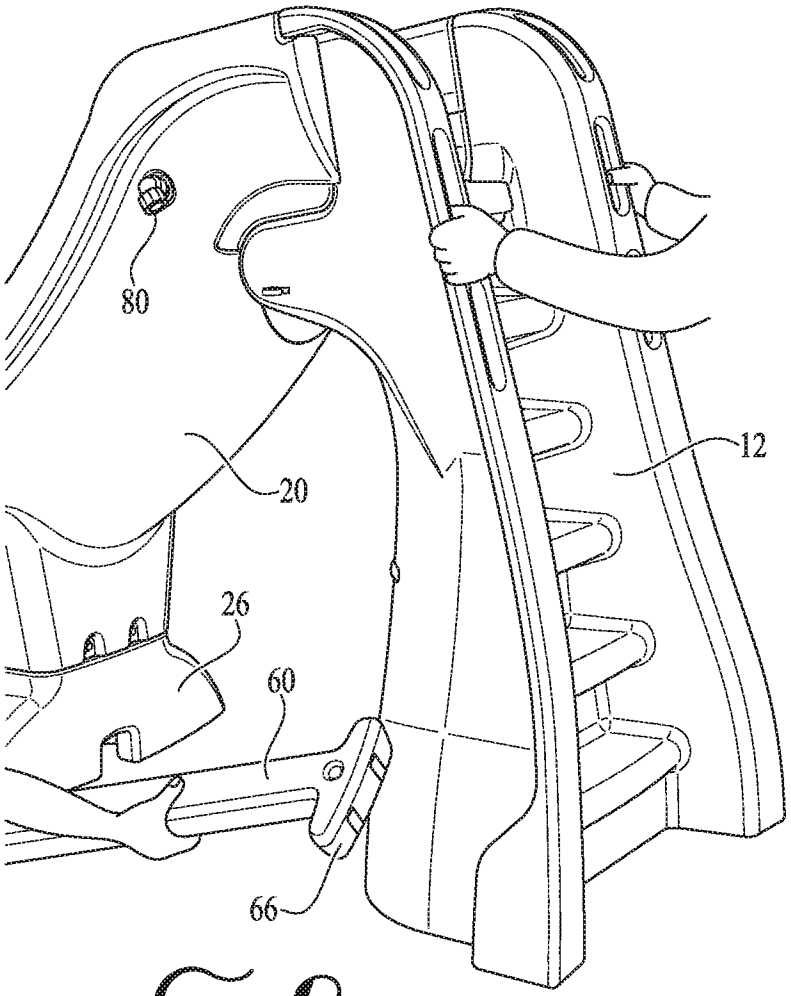

FIG. 10 is a front elevation view of the water slide 10 with the chute 20 removed to illustrate features of the tank 72. With reference to FIG. 10, the tank 72 includes a fill cap 74 that may be removed to provide access to the interior or the chamber or tank 72. Preferably, the tank 72 is marked with a visible fill line 76 indicating a minimum water level that will provide a desired stability for the water slide 10 during use. Once the water slide 10 is positioned at its desired location, the fill cap 74 may be removed, and the tank 72 may be filled with water (or other suitable liquid) to a desired level (preferably at least to the fill line 76). Once the tank 72 has been filled with water as desired, the water slide 10 is stabilized and ready for use. In some embodiments, the tank 72 preferably includes a drain port 78 positioned adjacent a bottom portion of the tank 72 for draining the water out of the tank 72 prior to disassembling the water slide 10. Preferably, the tank 72 is emptied prior to disassembling the water slide 10 to minimize the weight and facilitate the overall process.

Figure 11:
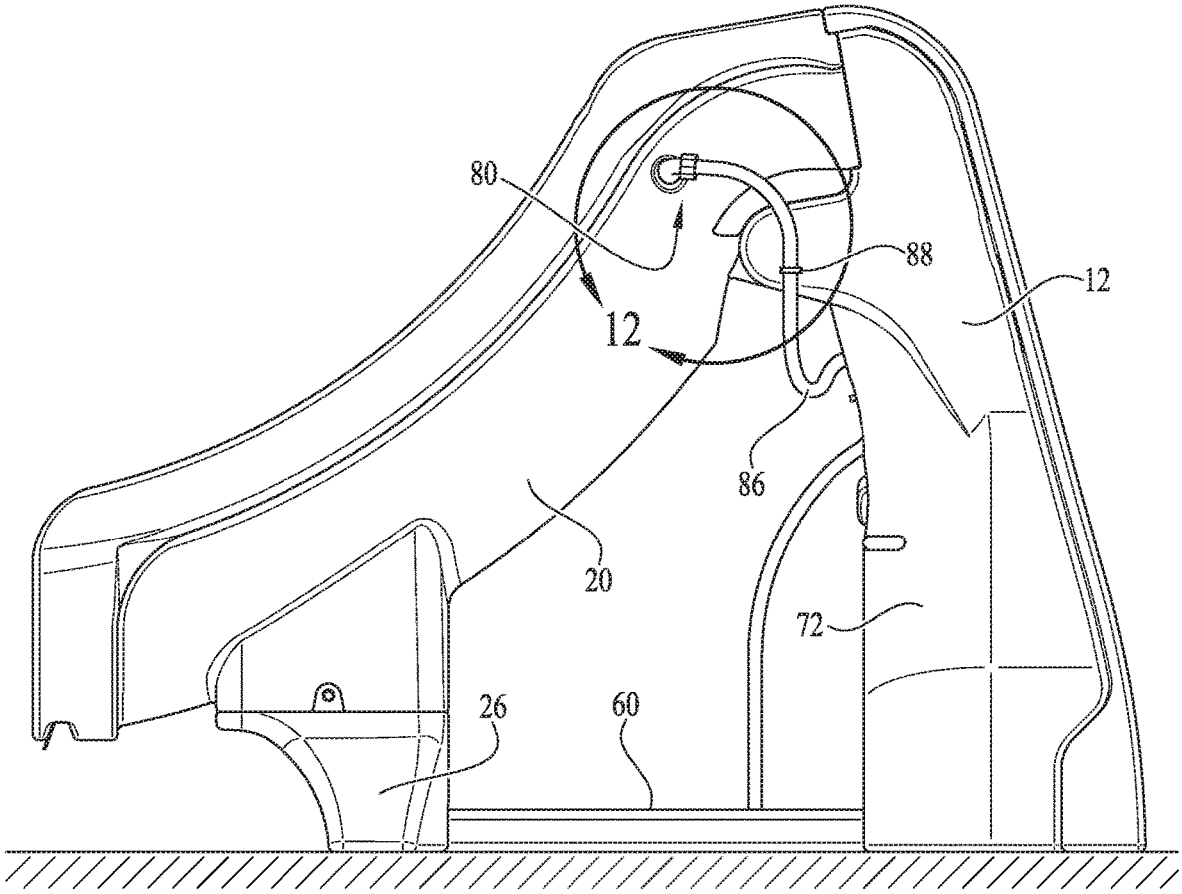
Figure 12:
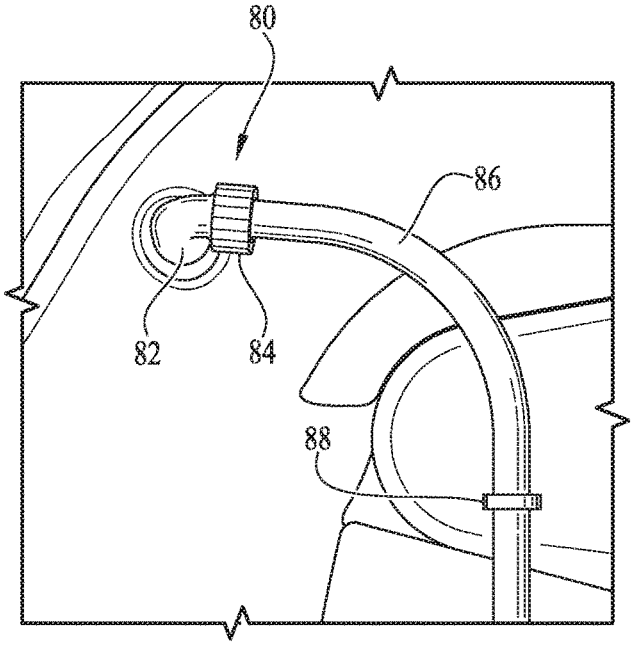

As illustrated in FIGS. 11 and 12, the water slide 10 further includes a water delivery system 80 designed to provide running water down the runway surface 22 of the water slide 10 as noted previously. With reference to FIGS. 11 and 12, the water delivery system 80 includes a water injection joint 82 including a first portion (not shown) threaded into the water slide 10 along a side surface of the chute 20. In one embodiment, the water injection joint 82 includes a hose adapter 84 designed to receive a standard water hose 86 connected to a water source (not shown). In some embodiments, the water slide 10 may include a plurality of hose clips 88 disposed along its exterior surface (e.g., coupled to the ladder section 12) for retaining the hose in a clean and secure fashion. The hose clips 88 may be positioned in any configuration to retain the hose 86 and help minimize potential tripping hazards. As illustrated in FIG. 1, the chute 20 includes an opening 90 formed adjacent the top platform 16 and in communication with the water injection joint 82, the opening 90 receiving water from the water hose 86 for dispersing the water down the runway surface 22 and into the pool.

As noted previously, when the water slide 10 is ready for disassembly, the water from the tank 72 is first released to simplify the disassembly process. To release the water, a cap (not shown) covering the drain port 78 is removed, thereby releasing the water from the tank 72. Once the tank 72 is empty, the water slide 10 may be leaned horizontally to simplify removal of the brace 60 from the platform 26 and ladder section 12. Once the brace 60 has been removed, the chute section 20 may be collapsed onto the ladder section 12, and a wheeled platform 58 may be inserted underneath the ladder section 12 to help transport the water slide 10 to another desired position, such as a storage area.

Preferably, the ladder section 12, first panel 38, tank 72, and arms 40, 42 are molded as one unitary structure from thick, durable polyethylene or other suitable material. Similarly, the chute 20, top platform 16, and arms 48, 50 are also molded as one unitary structure from thick, durable polyethylene or other suitable material. Finally, the brace 60 and platform 26 are also preferably molded from durable polyethylene or other suitable material.

Although the description above contains certain specific details, these details should not be construed as limiting the scope of the invention, but as merely providing illustrations of some embodiments/examples. It should be understood that subject matter disclosed in one portion herein can be combined with the subject matter of one or more of other portions herein as long as such combinations are not mutually exclusive or inoperable.

The terms and descriptions used herein are set forth by way of illustration only and not meant as limitations. It will be obvious to those having skill in the art that many changes may be made to the details of the above-described embodiments without departing from the underlying principles of the invention(s).

The invention claimed is:

1. A water slide comprising:

a ladder section with a plurality of steps, the ladder section further including one of a panel or a platform extending from an upper portion thereof;

a chute including a runway surface with an exit segment, the chute rotatably coupled to the ladder section, wherein the chute is movable between a first position and a second position relative to the ladder section, the chute further including the other of the panel or the platform extending from an upper portion thereof, wherein the panel is positioned underneath and supports the platform when the ladder section and the chute are coupled, and wherein the panel includes a first pair of arms each arm having a first opening formed therein and wherein the platform includes a second pair of arms each arm having a second opening formed therein;

a fastening pin extending between the first and second openings of the respective first and second pair of arms to rotatably couple the ladder section and chute together, and a brace having a first portion coupled to the ladder section and a second portion coupled to the chute, the brace extending between the ladder section and the chute to lock the chute when in the second position.

2. The water slide of claim 1, further comprising a fastener extending through the fastening pin to couple the fastening pin to one of the first pair of arms or the second pair of arms.

3. The water slide of claim 1, the ladder section further comprising a water tank configured for receiving water to stabilize the water slide.

4. The water slide of claim 3, wherein the water tank further includes a drain port operable for releasing water from the water tank.

5. The water slide of claim 3, the tank further including a visible fill indicator to denote a water level for the water tank.

6. The water slide of claim 1, further comprising a water delivery system operable to deliver a stream of water along the runway surface of the chute.

7. The water slide of claim 6, the water delivery system further comprising a water injection joint disposed along a top section of the chute, the water injection joint supplying a flow of water onto the runway surface.

8. The water slide of claim 7, further comprising a plurality of clips disposed on an exterior surface of the water slide along the ladder section, the clips configured to retain a water line connected to the water injection joint.

9. The water slide of claim 1, further comprising a support platform coupled to an underside of the chute, wherein the chute rests on the support platform to stabilize the water slide.

10. The water slide of claim 9, wherein the platform includes a first mating profile and the chute includes a corresponding second mating profile, the first and second mating profiles configured to engage one another to couple the support platform to the chute.

11. The water slide of claim 1, wherein the ladder section further comprises a first side wall and an opposite second side wall, and wherein each step in the plurality of steps extends from the first side wall to the second side wall, the ladder section further comprising a first plurality of handles, each handle in the first plurality of handles formed on the first side wall of the ladder section, and a second plurality of handles, each handle in the second plurality of handles formed on the second side wall of the ladder section.

12. The water slide of claim 11, wherein one or more of the steps in the plurality of steps further includes drain openings formed thereon, the drain openings operable to divert water away from the one or more steps.

13. The water slide of claim 1, further comprising a fastener extending through the fastening pin to secure the fastening pin to one of the first pair of arms or the second pair of arms.

14. The water slide of claim 1, wherein the ladder section, the one of the panel or the platform, the water tank, and the first pair of arms are formed as a first unitary structural member, and wherein the chute, the other of the panel or the platform, and the second pair of arms are formed as a second unitary structural member.

15. The water slide of claim 14, wherein the first unitary structural member and the second unitary structural member are each molded from a plastic material.

16. A water slide comprising:

a ladder section with a plurality of steps, the ladder section further including one of a panel or a platform extending from an upper portion thereof;

a chute including a runway surface with an exit segment, the chute rotatably coupled to the ladder section, wherein the chute is movable between a first position and a second position relative to the ladder section, the chute further including the other of the panel or the platform extending from an upper portion thereof, wherein the panel is positioned underneath and supports the platform when the ladder section and the chute are coupled;

a water tank configured for receiving water to stabilize the water slide; and a brace having a first portion coupled to the ladder section and a second portion coupled to the chute, the brace extending between the ladder section and the chute to lock the chute when in the second position, wherein the ladder section, the one of the panel or the platform, and the water tank are formed as a first unitary structural member, and wherein the chute and the other of the panel or the platform are formed as a second unitary structural member.

17. The water slide of claim 16, wherein the panel includes a first pair of arms each arm having a first opening formed therein, and wherein the platform includes a second pair of arms each arm having a second opening formed therein, and wherein the first pair of arms is formed as part of the first unitary structural member and wherein the second pair of arms is formed as part of the second unitary structural member.

18. A water slide comprising:

a ladder section with a plurality of steps, the ladder section further including a panel extending from an upper portion thereof;

a chute including a runway surface with an exit segment, the chute rotatably coupled to the ladder section, wherein the chute is movable between a first position and a second position relative to the ladder section, the chute further including a platform extending from an upper portion thereof, the platform having a lip formed along an end thereof, the lip extending downwardly from the platform, wherein the panel is positioned underneath and supports the platform, and the lip of the platform abuts against an edge surface of the panel when the ladder section and the chute are coupled to one another; and a brace having a first portion coupled to the ladder section and a second portion coupled to the chute, the brace extending between the ladder section and the chute to lock the chute when in the second position.

19. The water slide of claim 18, wherein the panel includes a first pair of arms each arm having a first opening formed therein, and wherein the platform includes a second pair of arms each arm having a second opening formed therein, the water slide further comprising a fastening pin extending between the first and second openings of the respective first and second pair of arms to rotatably couple the ladder section and chute together.

20. The water slide of claim 18, the water slide further comprising a water tank configured for receiving water to stabilize the water slide, wherein the ladder section, the panel, and the water tank are formed as a first unitary structural member, and wherein the chute and the platform are formed as a second unitary structural member.

* * * * *